US006065181A

United States Patent [19]

Cleveland et al.

[11] Patent Number: 6,065,181

[45] Date of Patent: May 23, 2000

[54] PORTABLE TICKET SCRATCHING DEVICE WITH VACUUM

[76] Inventors: Thomas Cleveland; Gregory A. Cleveland, both of 137 Oglethorpe Ave., Milledgeville, Ga. 31061

[21] Appl. No.: 09/146,498

[22] Filed: Sep. 3, 1998

[51] Int. Cl.[7] ..... A47L 5/26

[52] U.S. Cl. ..... 15/344; 15/93.1; 15/385

[58] Field of Search ..... 15/93.1, 344, 385

[56] References Cited

U.S. PATENT DOCUMENTS

| | | | |
|---|---|---|---|
| 1,189,648 | 7/1916 | Anderson | 15/385 X |
| 2,644,189 | 7/1953 | Calvin | 15/385 X |
| 2,664,586 | 1/1954 | Prins et al. | 15/93.1 X |
| 3,378,869 | 4/1968 | Schwartz | 15/93.1 |
| 3,380,093 | 4/1968 | Hill | 15/93.1 X |
| 3,934,302 | 1/1976 | Mabuchi | 15/344 X |
| 4,041,568 | 8/1977 | Rhodes | 15/385 X |
| 4,148,110 | 4/1979 | Muen | 15/385 |
| 5,794,303 | 8/1998 | Sanfilippo et al. | 15/344 |

*Primary Examiner*—Chris K. Moore

[57] ABSTRACT

A lottery ticket scratching device is provided including a housing adapted to contain at least one battery and a motor assembly including a motor mounted within the housing and including a rotor. Also included is a scratch assembly in communication with the rotor and positioned at an opening of the housing for removing a film from a ticket upon the rotation of the scratch assembly. A switch is connected between the motor and the battery for selectively rotating the scratch assembly.

6 Claims, 2 Drawing Sheets

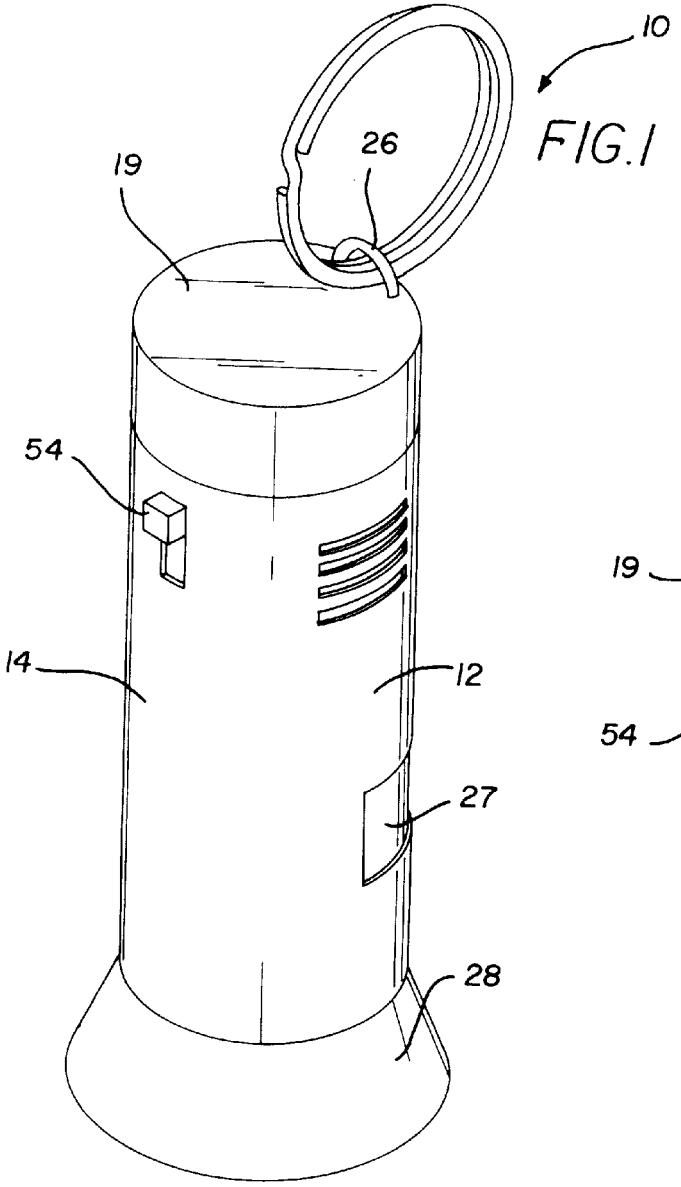
FIG.1
FIG.2
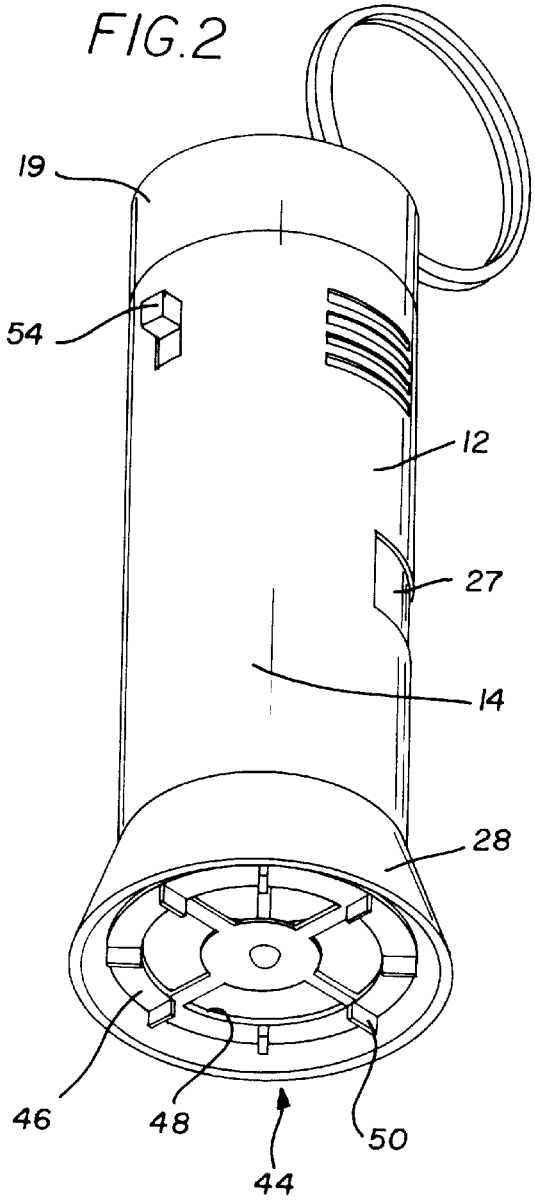

PORTABLE TICKET SCRATCHING DEVICE WITH VACUUM

BACKGROUND OF THE INVENTION

1. Field of the Invention

The present invention relates to ticket scratching devices and more particularly pertains to a new portable ticket scratching device with vacuum for scratching off and suctioning latex from a ticket.

2. Description of the Prior Art

The use of ticket scratching devices is known in the prior art. More specifically, ticket scratching devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art ticket scratching devices and the like include U.S. Pat. No. 4,765,842; U.S. Pat. No. 5,253,383; U.S. Pat. Des. 315,622; U.S. Pat. No. 4,956,892; U.S. Pat. No. 2,036,789; and U.S. Pat. No. 4,006,507.

In these respects, the portable ticket scratching device with vacuum according to the present invention substantially departs from the conventional concepts and designs of the prior art, and in so doing provides an apparatus primarily developed for the purpose of scratching off and suctioning latex from a ticket.

SUMMARY OF THE INVENTION

In view of the foregoing disadvantages inherent in the known types of ticket scratching devices now present in the prior art, the present invention provides a new portable ticket scratching device with vacuum construction wherein the same can be utilized for scratching off and suctioning latex from a ticket.

The general purpose of the present invention, which will be described subsequently in greater detail, is to provide a new portable ticket scratching device with vacuum apparatus and method which has many of the advantages of the ticket scratching devices mentioned heretofore and many novel features that result in a new portable ticket scratching device with vacuum which is not anticipated, rendered obvious, suggested, or even implied by any of the prior art ticket scratching devices, either alone or in any combination thereof.

To attain this, the present invention generally comprises a housing having an inboard extent with a hollow cylindrical configuration. As shown in FIG. 3, a divider is mounted in the inboard extent of the housing adjacent to an open first end thereof for defining a battery compartment adapted to contain a plurality of batteries. See FIG. 4. The open first end has a plurality of exterior threads formed in a peripheral edge thereof for releasably engaging a cover with a circular face. A peripheral lip is integrally coupled to a periphery of the circular face of the cover and extends therefrom with a plurality of interior threads. Further, the cover includes an eyelet mounted on the circular face for coupling with a key chain. The housing also has an outboard extent with a frustoconical configuration. The outboard extent of the housing is integrally coupled to a second end of the inboard extent in coaxial relationship therewith. Next provided is a filter screen mounted within the inboard extent of the housing at a central extent thereof. The filter screen serves for defining an inboard compartment and an outboard compartment. Note FIG. 3. With continuing reference to FIG. 3, a valve assembly includes a plate mounted within the housing at the second end of the inboard extent thereof. A pair of diametrically opposed openings are formed in the plate of the valve assembly. Each opening is equipped with a valve flap hingably mounted on an inner surface thereof. By this structure, the valve flap is adapted for only allowing the entry of air into the outboard compartment of the inboard extent of the housing. A motor assembly is provided including a motor mounted on the divider of the inboard extent of the housing. The motor includes a rotor extending from the motor in coaxial relationship with the housing. As shown in FIG. 3, the rotor is rotatably inserted through a central aperture of the filter screen and the plate of the valve assembly. The rotor is equipped with an end terminating adjacent to an open outboard end of the outboard extent of the housing. FIGS. 2 & 3 both depict a scratch assembly including a disk fixedly mounted on the end of the rotor of the motor assembly adjacent to and spaced from the open outboard end of the housing. The disk of the scratch assembly includes a plurality of semicircular cut outs formed therein. Further, a plurality of square tabs each have a first edge integrally coupled to the disk between the cut outs. Ideally, the tabs are coupled adjacent an outer periphery of the disk. Further, a second edge of the tab extends to a point flush with the open outboard end of the housing and resides within a plane that includes an axis of the rotor. In use, the tabs are adapted to remove latex from a ticket upon the rotation of the disk of the scratch assembly. Fixedly mounted on the rotor within the inboard compartment of the housing is an impeller. The impeller serves for suctioning air and the latex through the valve assembly upon the rotation of the impeller. It should be noted that the latex is deposited in the outboard compartment of the housing. Finally, a slider switch is mounted on the inboard extent of the housing adjacent the first end thereof. The switch is connected between the motor and the batteries for selectively rotating the impeller and the disk of the scratch assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable ticket scratching device with vacuum apparatus and method which has many of the advantages of the ticket scratching devices mentioned heretofore and many novel features that result in a new portable ticket scratching device with vacuum which is not anticipated, rendered obvious, suggested, or even implied by any of the prior art ticket scratching devices, either alone or in any combination thereof.

It is another object of the present invention to provide a new portable ticket scratching device with vacuum which may be easily and efficiently manufactured and marketed.

It is a further object of the present invention to provide a new portable ticket scratching device with vacuum which is of a durable and reliable construction.

An even further object of the present invention is to provide a new portable ticket scratching device with vacuum which is susceptible of a low cost of manufacture with regard to both materials and labor, and which accordingly is then susceptible of low prices of sale to the consuming public, thereby making such portable ticket scratching device with vacuum economically available to the buying public.

Still yet another object of the present invention is to provide a new portable ticket scratching device with vacuum which provides in the apparatuses and methods of the prior art some of the advantages thereof, while simultaneously overcoming some of the disadvantages normally associated therewith.

Still another object of the present invention is to provide a new portable ticket scratching device with vacuum for scratching off and suctioning latex from a ticket.

Even still another object of the present invention is to provide a new portable ticket scratching device with vacuum that includes a housing adapted to contain at least one battery and a motor assembly including a motor mounted within the housing and including a rotor. Also included is a scratch assembly in communication with the rotor and positioned at an opening of the housing for removing a film from a ticket upon the rotation of the scratch assembly. A switch is connected between the motor and the battery for selectively rotating the scratch assembly.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a top perspective view of a new portable ticket scratching device with vacuum according to the present invention.

FIG. 2 is a bottom perspective view of the present invention.

DESCRIPTION OF THE PREFERRED EMBODIMENT

Figure 3:
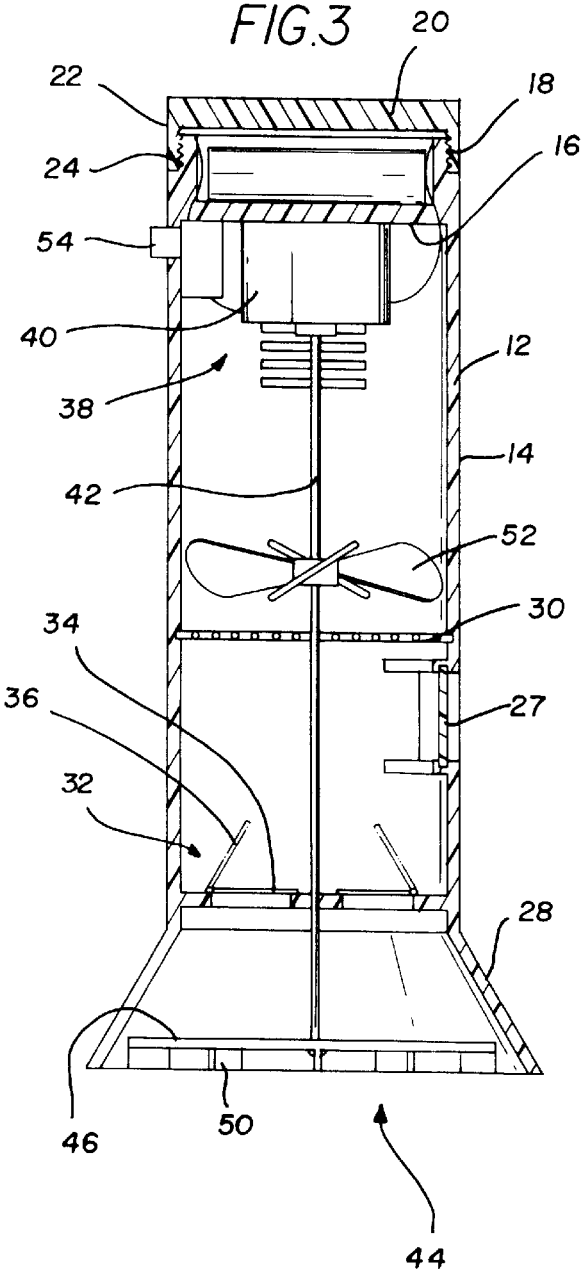
FIG. 3 is a side cross-sectional view of the present invention.
Figure 4:
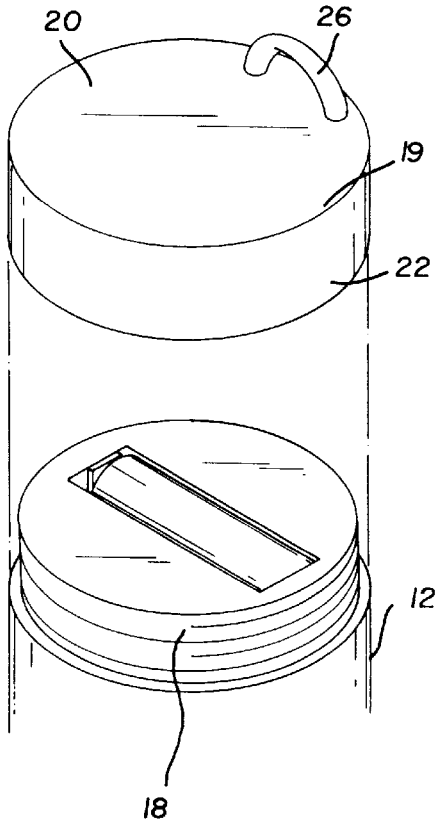
FIG. 4 is a top view of the present invention with the cover of the battery compartment removed.

With reference now to the drawings, and in particular to FIGS. 1 through 4 thereof, a new portable ticket scratching device with vacuum embodying the principles and concepts of the present invention and generally designated by the reference numeral 10 will be described.

The present invention, designated as numeral 10, includes a housing 12 having an inboard extent 14 with a hollow cylindrical configuration. As shown in FIG. 3, a divider 16 is mounted in the inboard extent of the housing adjacent to an open first end thereof for defining a battery compartment adapted to contain a plurality of batteries. See FIG. 4.

The open first end of the inboard extent of the housing has a plurality of exterior threads 18 formed in a peripheral edge thereof for releasably engaging a cover. A peripheral lip 22 is integrally coupled to a periphery of a circular face 20 of the cover and extends therefrom with a plurality of interior threads 24. Further, the cover includes an eyelet 26 mounted on the circular face for coupling with a key chain. For reasons that will soon become apparent, a sliding door 27 is mounted on the housing for allowing access to the interior space of the housing.

The housing also has an outboard extent 28 with a frusto-conical configuration. The outboard extent of the housing is integrally coupled to a second end of the inboard extent in coaxial relationship therewith. As shown in the Figures, the outboard extent has a length which is less than ¼ that of the inboard extent.

Next provided is a filter screen 30 mounted within the inboard extent of the housing at a central extent thereof. The filter screen serves for defining an inboard compartment and an outboard compartment. Note FIG. 3. The filter screen is preferably maintained in place by way of an annular recess formed in an interior surface of the housing.

With continuing reference to FIG. 3, a valve assembly 32 includes a plate mounted within the housing at the second end of the inboard extent thereof. A pair of diametrically opposed openings 34 are formed in the plate of the valve assembly. Each opening is equipped with a valve flap 36 hingably mounted on an inner surface thereof by way of a living hinge. As such, the valve flap has a normally unbiased orientation for covering the associated opening. By this structure, the valve flap is adapted for only allowing the entry of air and particles into the outboard compartment of the inboard extent of the housing.

A motor assembly 38 is provided including a motor 40 mounted on the divider of the inboard extent of the housing. The motor includes a rotor 42 extending from the motor in coaxial relationship with the housing. As shown in FIG. 3, the rotor is rotatably inserted through a central aperture of the filter screen and the plate of the valve assembly. The rotor is equipped with an end terminating adjacent to an open outboard end of the outboard extent of the housing. As shown in FIGS. 1–3, the housing has a plurality of vent apertures formed therein adjacent to the motor.

FIGS. 2 & 3 both depict a scratch assembly 44 including a disk 46 fixedly mounted on the end of the rotor of the motor assembly adjacent to and spaced from the open outboard end of the housing. The disk of the scratch assembly includes a plurality of semicircular cut outs 48 formed therein. Such cut outs define a central circular inner portion with a plurality of radially extending strips connected to an annular outer portion. Further, a plurality of square tabs 50 each have a first edge integrally coupled to the annular outer portion of the disk between the cut outs. Ideally, the tabs are coupled adjacent an outer periphery of the disk. Further, a second edge of the tab extends to a point flush with the open outboard end of the housing and resides within a plane that includes an axis of the rotor. In use, the tabs are adapted to remove latex or other film from a ticket upon the rotation of the disk of the scratch assembly.

Fixedly mounted on the rotor within the inboard compartment of the housing is an impeller 52. The impeller serves for suctioning air and the latex through the valve assembly upon the rotation of the impeller. It should be noted that the latex is deposited in the outboard compartment of the housing during operation.

Finally, a slider switch 54 is mounted on the inboard extent of the housing adjacent the first end thereof. The switch is connected between the motor and the batteries for selectively rotating the impeller and the disk of the scratch assembly. After use, the latex may be removed from the outboard compartment of the housing by way of the sliding door 27.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A lottery ticket scratch and vacuum device comprising, in combination:

a housing including an inboard extent with a hollow cylindrical configuration having a divider mounted therein adjacent to an open first end thereof for defining a battery compartment adapted to contain a plurality of batteries, the open first end having a plurality of exterior threads formed in a peripheral edge thereof for releasably engaging a cover including a circular face with an eyelet and a peripheral lip coupled to a periphery of the circular face of the cover and extending therefrom with a plurality of interior threads, the housing further including an outboard extent with a frustoconical configuration integrally coupled to a second end of the inboard extent in coaxial relationship therewith;

a filter screen mounted within the inboard extent of the housing at a central extent thereof for defining an inboard compartment and an outboard compartment;

a valve assembly including a plate mounted within the housing at the second end of the inboard extent thereof with a pair of diametrically opposed openings formed therein each having a valve flap hingably mounted on an inner surface thereof for only allowing the entry of air into the outboard compartment of the inboard extent of the housing;

a motor assembly including a motor mounted on the divider of the inboard extent of the housing and including a rotor extending from the motor in coaxial relationship with the housing and rotatably inserted through a central aperture of the filter screen and the plate of the valve assembly with the rotor having an end terminating adjacent to an open outboard end of the outboard extent of the housing;

a scratch assembly including a disk fixedly mounted on the end of the rotor of the motor assembly adjacent to and spaced from the open outboard end of the housing and in coaxial relationship therewith, the disk of the scratch assembly including a plurality of cut outs formed therein and a plurality of square tabs, each of said cut outs having a quarter circle shape, each of said square tabs having a first edge integrally coupled to the disk between the cut outs adjacent to an outer periphery of the disk such that a second edge of the tab extends to a point flush with the open outboard end of the housing and resides within a plane that includes an axis of the rotor, wherein the tabs are adapted to remove latex from a ticket upon the rotation of the disk of the scratch assembly;

an impeller fixedly mounted on the rotor within the inboard compartment of the housing for suctioning air and the latex through the valve assembly upon the rotation of the impeller, wherein the latex is deposited in the outboard compartment of the housing; and a slider switch mounted on the inboard extent of the housing adjacent the first end thereof and connected between the motor and the batteries for selectively permitting rotation of the impeller and the disk of the scratch assembly.

2. A ticket scratching device comprising:

a housing adapted to contain at least one battery;

a motor assembly including a motor mounted within the housing and including a rotor;

a scratch assembly mounted on the rotor and positioned at an opening of the housing for removing material from a ticket upon the rotation of the scratch assembly;

a switch connected between the motor of the motor assembly and the at least one battery for selectively permitting rotation of the scratch assembly; and wherein the scratch assembly includes a disk having a plurality of cut outs formed therein and a plurality of tabs each having a first edge integrally coupled to the disk such that a second edge of the tab extends to a point flush with the open end of the housing and resides within a plane that includes an axis of rotation of the disk.

3. A ticket scratching device as set forth in claim 2 wherein an impeller is mounted on the rotor for suctioning the material into the housing after removal by the scratch assembly.

4. A ticket scratching device as set forth in claim 3 wherein a filter is situated within the housing between the impeller and the scratch assembly.

5. A ticket scratching device as set forth in claim 3 wherein at least one valve is situated within the housing between the impeller and the scratch assembly.

6. A ticket scratching device as set forth in claim 2 wherein a connector is mounted on the housing for coupling with a key chain.

* * * * *